US006896026B2

(12) United States Patent
Martin

(10) Patent No.: US 6,896,026 B2
(45) Date of Patent: May 24, 2005

(54) INSECT SCREENS

(76) Inventor: Conrad Peter Martin, 66 Ovesdom Avenue, Harrow, Middlesex (GB), HA2 9PD ( * ) Notice: Subject to any disclaimer, the term of this patent is extended or adjusted under 35 U.S.C. 154(b) by 0 days.

(21) Appl. No.: 10/010,376

(22) Filed: Dec. 6, 2001

(65) Prior Publication Data

US 2003/0019181 A1 Jan. 30, 2003

(30) Foreign Application Priority Data

Jul. 30, 2001 (GB) ..... 0118513

(51) Int. Cl.[7] ..... A47H 1/00
(52) U.S. Cl. ..... 160/105; 160/273.1; 52/656.1
(58) Field of Search ..... 160/105, 26, 31, 160/111, 118, 120, 194, 273.1, 371, 290.1; 52/656.1, 197, 209

(56) References Cited

U.S. PATENT DOCUMENTS 3,566,950 A * 3/1971 Collins ..... 49/406
3,710,839 A * 1/1973 Andres ..... 160/372
3,808,742 A * 5/1974 Ehret et al. ..... 49/413
3,837,118 A * 9/1974 Goss, Jr. et al. ..... 49/61
4,249,589 A * 2/1981 Loeb ..... 160/368 R
4,262,450 A * 4/1981 Anderson ..... 49/425
4,267,874 A * 5/1981 Pope ..... 160/92
4,311,183 A * 1/1982 Herbst et al. ..... 160/37
4,532,743 A * 8/1985 Miller et al. ..... 52/207
4,570,381 A * 2/1986 Sterner, Jr. ..... 49/129
4,819,295 A * 4/1989 Kaftan ..... 16/72
4,891,921 A * 1/1990 Governale ..... 52/207
4,924,628 A * 5/1990 Ruby et al. ..... 49/380
4,993,471 A * 2/1991 Golden ..... 160/370.2
5,097,886 A * 3/1992 Moyet-Ortiz ..... 160/368.1
5,099,905 A * 3/1992 Rigter ..... 160/273.1
5,105,868 A * 4/1992 Riise ..... 160/90
5,323,835 A * 6/1994 Bachmeier ..... 160/89
5,659,999 A * 8/1997 Benson ..... 49/404
5,694,718 A * 12/1997 Norton ..... 49/440
5,720,080 A * 2/1998 Rose ..... 16/74
5,758,704 A * 6/1998 Elrod ..... 160/98
6,016,861 A * 1/2000 Davis ..... 160/105
6,082,432 A * 7/2000 Kissinger ..... 160/290.1
6,123,135 A * 9/2000 Mathews ..... 160/26
6,138,739 A * 10/2000 Crider et al. ..... 160/273.1
6,276,091 B1 * 8/2001 Ridgway ..... 49/125
6,490,832 B1 * 12/2002 Fischbach et al. ..... 52/207
2001/0042348 A1 * 11/2001 Lundahl ..... 52/202
2003/0019172 A1 * 1/2003 Martin ..... 52/197
2003/0019173 A1 * 1/2003 Martin ..... 52/209

FOREIGN PATENT DOCUMENTS

JP 31681 * 1/2000 ..... 160/273.1 X

* cited by examiner

*Primary Examiner*—Bruce A. Lev
(74) *Attorney, Agent, or Firm*—Galgano & Burke, LLP

(57) ABSTRACT

An improved flyscreen to be slidingly deployed across an opening of window or door, the window or door having a static glazing pane or panel and an opening pane or panel, the flyscreen comprising a frame dimensioned to correspond to the dimensions of the window or door opening to be covered by the flyscreen and having a mesh screen therein extending thereacross, the frame having a brush or filamentous pad strip extending substantially the full height of an upright of the frame and which when the screen is slidingly mounted adjacent to a window or door to be slidingly moved back and forth across the opening of the window or door, is substantially able to brush over the surface of the static pane or panel of the window or door.

20 Claims, 5 Drawing Sheets

INSECT SCREENS

FIELD OF THE INVENTION

The present invention concerns improvements in and relating to insect/fly screens for mounting over door and window openings.

BACKGROUND TO THE INVENTION

Whereas there are currently commercially available a number of different designs of insect/fly screens that are adapted to mount over door and window openings, many of these are hinged to the surround of the opening and are not optimally convenient in use.

More sophisticated fly screen systems have become available in recent years and which are designed to slide on tracks across a door or window opening. As a generality, however, these are formed with a bulky, rigid frame defining the tracks as well as a comparatively bulky and rigid frame of the flyscreen itself.

It is a general object of the present invention to provide a comparatively slim, compact and economical flyscreen installation and which is reliably effective and may be adapted to suit a number of different types of door and window configuration.

SUMMARY OF THE INVENTION

According to a first aspect of the present invention there is provided an improved flyscreen to be slidingly deployed across an opening of window or door, the window or door having a static glazing pane or panel and an opening pane or panel, the flyscreen comprising a frame dimensioned to correspond to the dimensions of the window or door opening to be covered by the flyscreen and having a mesh screen therein extending thereacross, the frame having a brush or filamentous pad strip extending substantially the full height of an upright of the frame and which when the screen is slidingly mounted adjacent to a window or door to be slidingly moved back and forth across the opening of the window or door, is substantially able to brush over the surface of the static pane or panel of the window or door.

Advantageously the flyscreen is installed to a window or door and wherein the upright/jamb of the window or door which defines one side of the opening of the window or door against which the trailing edge upright of the flyscreen frame comes to rest when the screen is drawn to overlie the opening has a mating brush or filamentous pad strip thereon extending at least substantially the length thereof to co-operatively engage/abutt against the brush or filamentous pad strip of the frame to substantially seal the edge of that frame against ingress by any insects.

Preferably the fly screen is adapted to mount to a sliding window or door having a handle that projects substantially from the plane of the window or door, wherein the brush or filamentous pad strip on the frame is provided on a projecting limb of the frame that projects from the frame toward the plane of the door or window static pane, allowing the mesh screen to clear the door or window handle but ensure that the brush or filamentous pad strip remains closed or brushes over the surface of the door or window static pane as the frame is slid back and forth.

Preferably the projecting limb is adapted to be demountable from the frame.

Advantageously a plurality of interchangeable projecting limbs are provided of differing projection extents to suit different extents of projection of the door or window handles.

Suitably a brush or filamentous pad strip is provided extending along substantially the full length of the top edge of the frame.

Preferably a brush or filamentous pad strip is provided extending along substantially the full length of the bottom edge of the frame.

Suitably a brush or filamentous pad strip is provided extending along the top edge and/or bottom edge of the projecting limb of the frame.

According to a second aspect of the present invention there is provided an improved flyscreen to be slidingly deployed across the opening of a window or door and being of horizontal roller screen type having a mesh flyscreen on a roller that is mounted, in use, to a top, bottom or side of a door or window opening to be drawn across the opening, the flyscreen assembly further comprising a pair of guide rails extending in use opposite to each other to guide the opposing side edges of the screen as it is extended, wherein at least one and suitably both of the guide rails has a brush extending therealong substantially the length thereof and is/are provided with an adjustable stabiliser/gripping bar extending therealong substantially the length thereof to grip and stabilise the screen against the brush(es) to counter sag and/or disturbance by the wind or other disruptive forces.

Preferably the stabilising/gripping bars are provided with Velcro™ or other fastening means to fasten to the edge of the mesh screen, gripping the screen in place.

Advantageously the roller blind is arranged to extend in a substantially vertical direction and the screen is extended or retracted by a drawstring.

Preferably the screen is arranged vertically and the leading edge of the screen has a bar extending thereacross which is weighted to facilitate stable deployment of the screen.

Advantageously the roll of the roller blind is held in a roller cassette and wherein the cassette is provided with two rows of brush means, one inward of the other relative to the opening of the roller cassette from which the screen is drawn, whereby the second row of brush means acts as a secondary barrier against ingress of flies.

BRIEF DESCRIPTION OF THE DRAWINGS

A preferred embodiment of the present invention will now be more particularly described by way of example with reference to the accompanying drawings, wherein.

DESCRIPTION OF THE PREFERRED EMBODIMENT

Figure 1A:
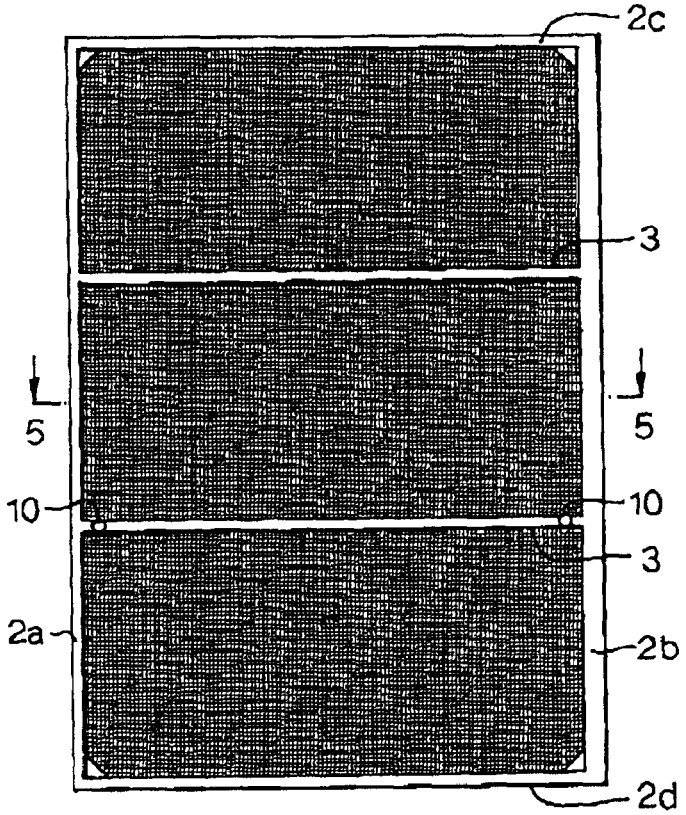
FIGS. 1A and 1B are, respectively, front and rear elevation views of a first embodiment of flyscreen, to be mounted on tracks to slide across a door opening in a set of French windows.
Figure 1B:
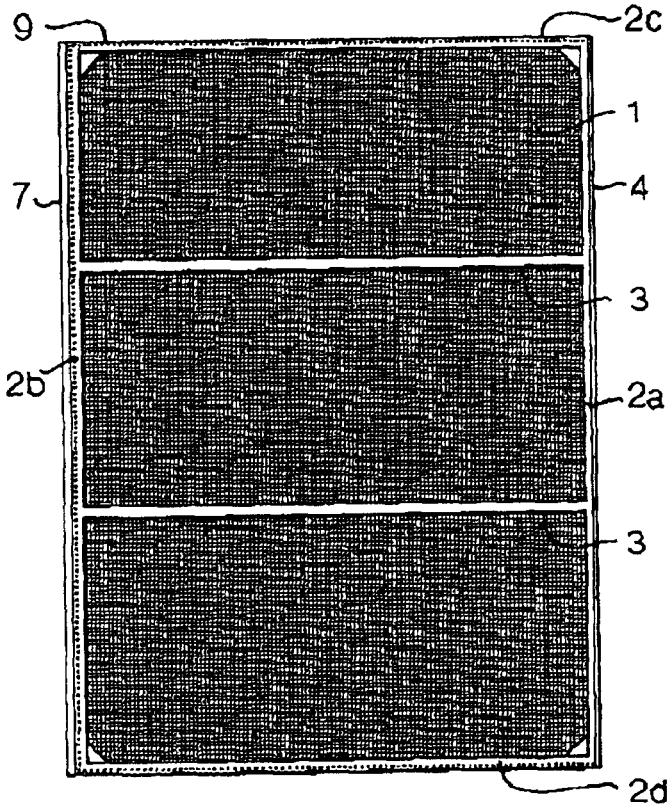
Figure 2:
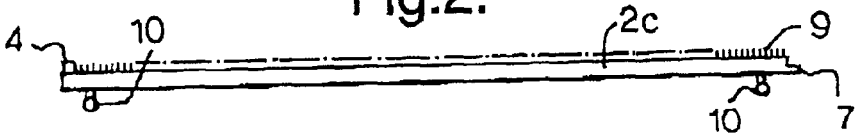
FIG. 2 is a plan view of the flyscreen of the first embodiment from above.
Figure 3:
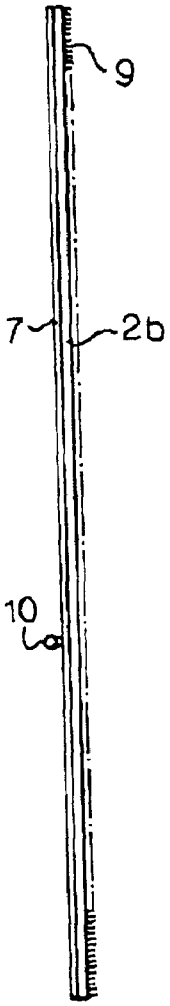
FIG. 3 is an end elevation view of the leading end of the flyscreen.
Figure 4:
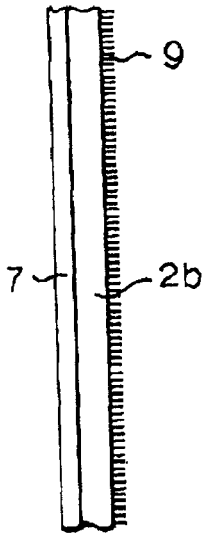
FIG. 4 is an enlarged fragmentary view of the same.
Figure 5:
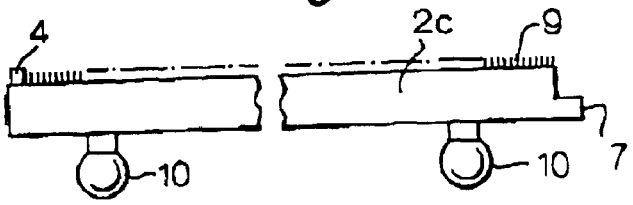
FIGS. 5 and 6 are, respectively, an enlarged fragmentary plan view of the screen as seen in FIG. 2, and a horizontal sectional view of the same.
Figure 6:
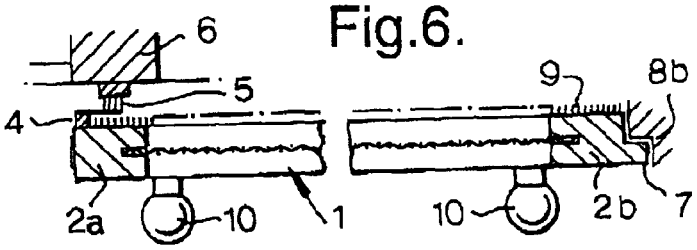

As illustrated in FIGS. 1 to 6, the first embodiment of the insect screen is suitable for use with French windows (glazed sliding doors) and may also be used as a sun screen. It comprises a mesh sheet 1 held substantially taut within a rectangular frame 2*a–d*. This is of a size and shape that corresponds to the size and shape of the French windows or other sliding door installation against which it is adapted to sit. The frame 2*a–d* mounts within an additional channel retro-fitted to or integral with the track of the sliding French window in order to be able to slide across the door opening when the French window/door is slid back to its opened state.

The mesh of the mesh sheet 1 is suitably sufficiently fine to exclude the smallest of flying insects such as midges, gnats and mosquitoes. It is suitably of a plastics polymer such as nylon—in which case horizontal strengthening bars 3 are suitably provided at intervals which are suitably equal intervals, of the height of the screen extending across the width of the screen. However, where the mesh is formed of a substantially rigid material such as aluminium or other metal or metal alloy, such additional strengthening is generally unnecessary other than, if desired, to act as a clear visual warning that the screen is drawn across the door opening to prevent individuals from failing to notice the fine unobtrusive screen and walking into it.

As can be seen from the side elevation, the insect screen has an extremely slim profile which in practice suitably of the order of 20 mm or less and generally of the order of 15 mm.

The rectangular frame 2*a–d* is suitably formed of a pair of uprights/stiles 2*a*, 2*b* and top and bottom opposing cross-bars 2*c*, 2*d* all of aluminium, hard, hardened or strengthened plastics, wood or other suitable material that is lightweight but reasonably rigid.

The trailing edge stile 2*a* of the frame has a vertically extending brush 4 (preferably bristle brush) which is adapted to ride smoothly over the surface of the underlying static glazing pane of the French windows without damage to the glass if the screen should be pressed against the glass. It co-operatively engages with a corresponding vertically extending brush 5 that is mounted on the static stile 6 of the French windows that borders the door opening opposite the jamb 6. Abutment of the vertical brush 4 on the trailing edge stile 2*a* of the screen frame against the vertical brush on the static stile 6 gives a firm and insect tight closure of the door opening when the screen is drawn across the opening.

The leading edge of the leading stile 2*b* of the screen has a lip 7 which sits closely against the rail 8*b* on the door jamb to close that other side of the door opening, There is generally no need for a further brush or other sealing element at that end.

Each of the top and bottom cross-bars 2*c*, 2*d* has their own respective brush 9,10 extending horizontally the length thereof to seal the screen respectively from top and bottom.

The illustrated configuration of fly screen has a pair of small handle knobs 10 provided on one of the transverse strengthening bars 3, one knob 10 at each end. A small handle (not shown) is suitably provided on the alternate face of the screen for handling the screen from the outside. This is suitably provided on the transverse bar 3 or on the leading edge stile 2*b* that is particularly suitably pivotable to collapse substantially flat against the screen so that when the screen is fully retracted back against the static pane of the French windows the screen lies very closely against the static pane of the French windows.

By way of further detail apparent in the figures, the screen is provided with triangular corner pieces at each corner of the frame to better hold the mesh of the screen in place within the frame.

Figure 7A:
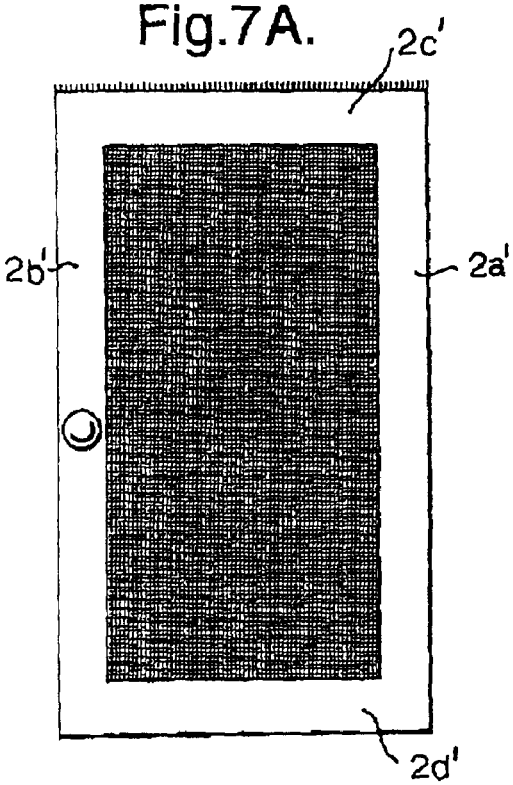
FIGS. 7A and 7B are, respectively, front and rear elevation views of the second preferred embodiment of the present invention suitable for use with sliding windows.
Figure 7B:
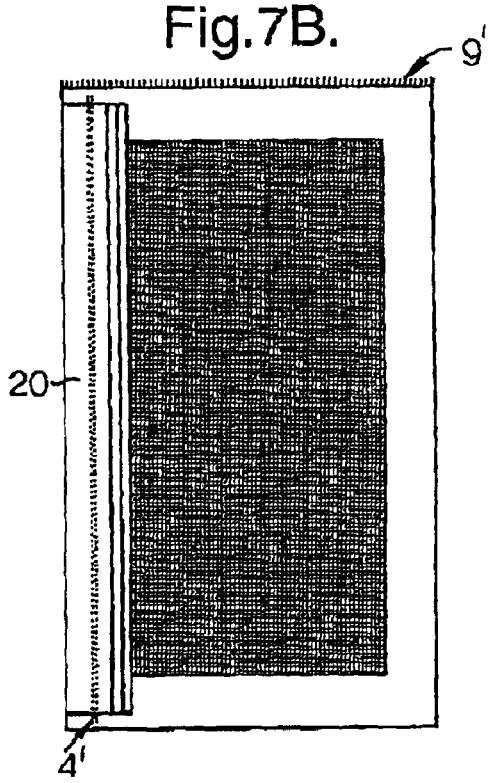
Figure 8:
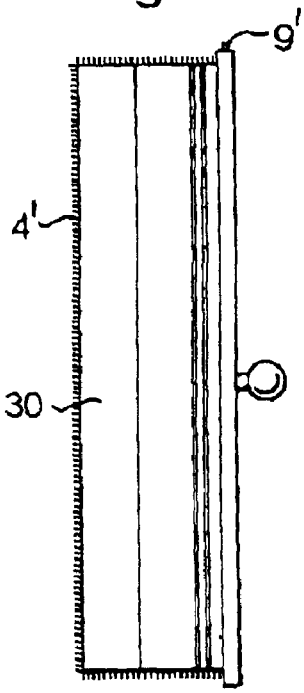
FIG. 8 is an end elevation view of the second preferred embodiment of fly screen.
Figure 9A:
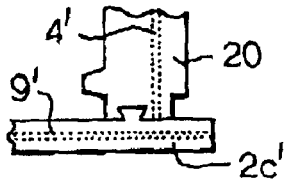
FIG. 9A is a fragmentary view of the dovetail mounting of the projecting limb to the fly screen frame of the FIG. 9 embodiment.
Figure 9:
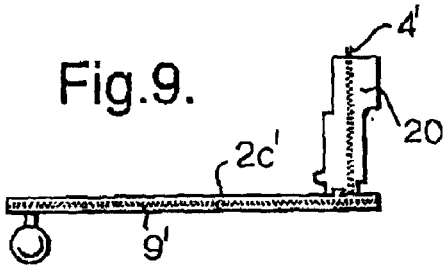
FIG. 9 is a plan view of the second preferred embodiment from above.
Figure 10:
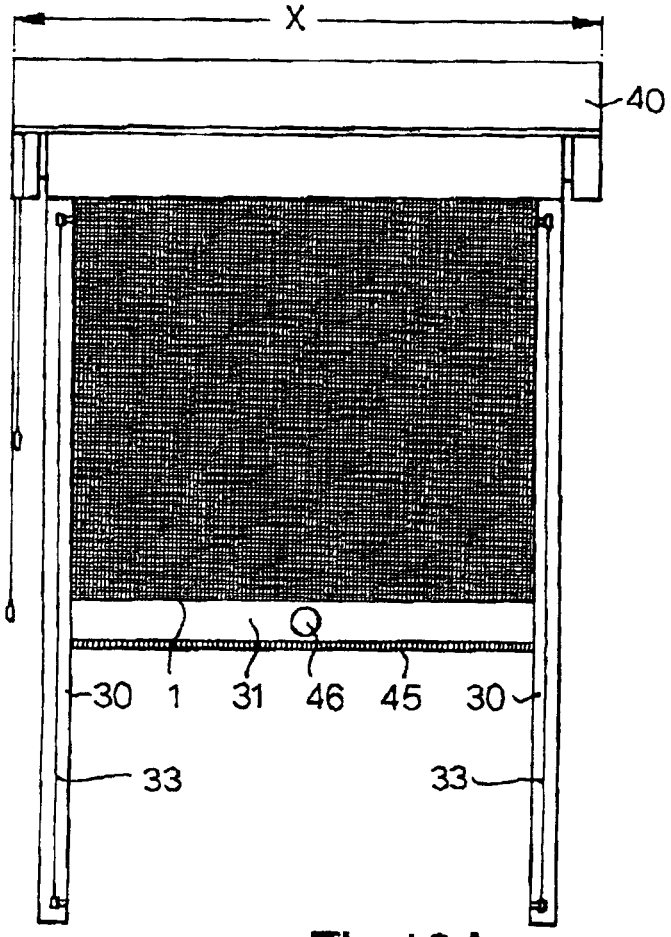
FIG. 10 is a front elevation view of a third preferred embodiment of the invention, comprising a flyscreen of roller screen type.
Figure 11:
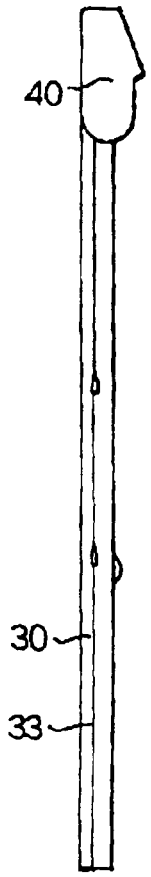
FIG. 11 is an end elevation view of the FIG. 10 embodiment.
Figure 12:
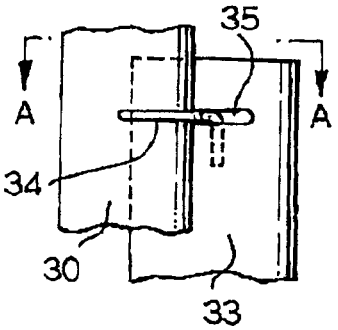
FIG. 12 is a fragmentary view of a track and stabilising/gripping bar as viewed from the left hand side at detail A in FIG. 10.
Figure 13A:
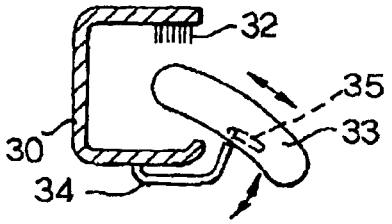
FIGS. 13A and 13B are, respectively, fragmentary plan views from above of the details shown in FIG. 12 and showing the stabilising/gripping bar partially released and in locking engaged state, respectively.
Figure 13B:
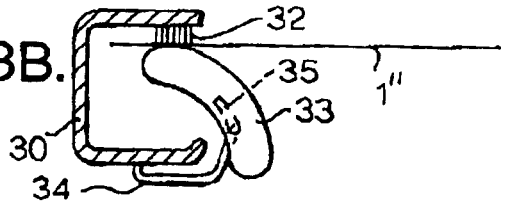
Figure 14A:
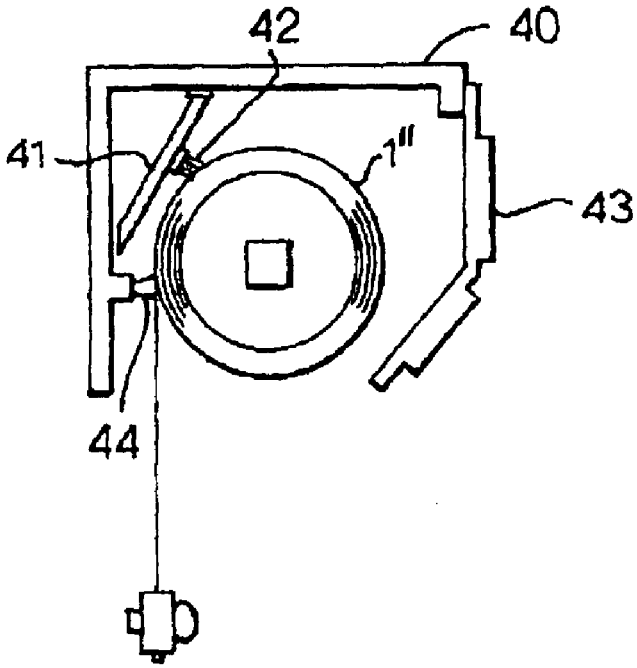
FIGS. 14A and 14B are, respectively, a transverse sectional view through the roller screen top casing/roller cassette and a frontal view of the secondary brush component thereof.
Figure 14B:
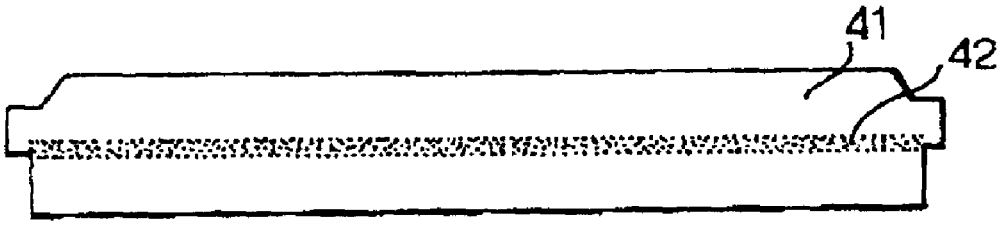

A second embodiment of the invention, comprising a fly screen for sliding windows, is illustrated in FIGS. 7 to 9 and has a rigid rectangular frame construction in common with the first aspect The materials and construction are suitably generally the same. However, the trailing edge stile 2*a*' of the fly screen frame 2*a*'–2*d*' is provided with an extension profile 20 that carries the brush 4' of the trailing end of the frame and which is dimensioned to enable the brush 4' to maintain continuous contact with the underlying window while giving the fly screen clearance of the window handle. The depth of the extension 20 is adapted to suit the required clearance.

In a particularly preferred embodiment the extension profile 20 is demountable from the fly screen trailing edge stile 2*a*' to enable selection of the appropriate depth of extension 20 from amongst alternatives. The extension profile suitably keys to the frame by a sliding dovetail arrangement 21 or other keying arrangement.

Brushes are suitably provided not only along the top and bottom bars and the profile extension of the trailing edge but optionally also at the leading edge. Where a brush is provided down the leading edge 2*b*' this is suitably a felt brush rather than a bristle brush in contrast to the others.

As in the embodiment of FIGS. 1 to 6, the brush 4' will abut/engage with a corresponding brush 6' on an upright of the sliding window when the screen 1' is fully extended across the window opening.

Turning now to FIGS. 10 to 13, these illustrate a roller blind-like insect screen which has a mesh sheet 1" on a roll that may be pulled downwardly with its opposing lateral edges running in a pair of upright U-shaped channel tracks 30.

It may optionally also have a corresponding bottom track (not shown). It is preferably cord adjustable for deployment, since a spring-loaded gravity drop mechanism is unreliable.

The bottom bar 31 of the screen is suitably weighted with lead weights or the like to give stability and provide balance from front to back of the bar 31. A handle knob 46 is provided mid-way along the bar 31 to facilitate manual manipulation into place.

The strength of the screen 1 and support for the weighted bottom bar 31 is enhanced through provision of thickened solid 1cm edging to the screen 1.

The top casing/roller cassette 40 has a removable front cover 43 and along the back thereof, a brush 44 extending the length thereof to exclude flies.

A removable secondary fly trap is suitably positioned in the top casing/roller cassette 40 of the roller comprising a plastic moulding 41 that hangs from the roof of the cassette 40 and extends the length of the roller the moulding 41 having a brush 42 running along its length that rests on the screen roll 1" and accordingly remains continuously in contact with the screen roll 1" as the screen is extended or retracted and as the roll 1" correspondingly decreases or increases in diameter.

The upright tracks 30 on either side of the roller screen 1" each have a bristle brush 32 along one longitudinal edge and a stabiliser panel/wing 33 along the opposing longitudinal edge. Each of the wings 33 is adjustably mounted to its track 30 on hinges 34. The hinges 34 take the form of bent pins being elongate and mounting in slots 35 in the wings 33 so that the wings 33 may be deployed by pulling laterally across and pivoting outwardly to release the edges of the roller blind screen 1" to allow it to be pulled down. The wings 33 are then pivoted back and pushed back into the tracks 30 so that their curved rear faces push into and thereby to grip the fly screen against the brushes 32 in the tracks 30 once the screen is fully drawn down and deployed.

A strip of Velcro™ or similar is suitably provided on the rear face of each wing 33 preferably extending substantially along its length to enhance its grip. This gripping of the fly screen once the screen is deployed holds it firmly in place against any gusts of wind.

In the absence of a bottom track or not, the bottom edge/leading edge of the screen is suitably provided with a short felt brush 45 therealong and which effectively seals against the windowsill.

What is claimed is:

1. An improved flyscreen and door assembly comprising:

a door having a static panel and a generally horizontally slidable opening panel and a generally upright jamb defining one side of an opening of the door;

a flyscreen comprising a track and a reciprocably slidable frame within said track, said frame slidingly deployed within said track for back and forth movement across the opening of the door, said frame being dimensioned to correspond to the dimensions of the door opening to be covered by the flyscreen, said frame having a mesh screen therein extending thereacross and having generally upright lateral sides;

a first brush mounted on and extending substantially the full length of one of said lateral sides of said slidable frame which first brush is positioned such that, when said slidable frame slidingly moves back and forth in front of the opening of the door, said first brush passes closely over the surface of the static panel of the door, wherein said first brush mounted on said slidable frame is provided on a projecting limb of said slidable frame that projects from said slidable frame toward the plane of said door static panel but is dimensioned so as to allow said flyscreen to clear a door handle but ensure that said first brush remains in close proximity to the door static panel as said slidable frame is slid back and forth; and a second brush mounted on said generally upright jamb of the door against which the edge of the trailing lateral side of the slidable frame comes to rest when the flyscreen is drawn closed to completely overlie the opening of the door, said second brush extending substantially the height of said jamb and serving to cooperatively engage against said first brush mounted on said slidable frame to substantially seal the edge of said trailing lateral side of said slidable frame against ingress by insects.

2. An improved flyscreen and door assembly as claimed in claim 1, wherein at least one of said static panel and said opening panel is a glazing pane.

3. An improved flyscreen and door assembly as claimed in claim 1, wherein at least one of said first brush and said second brush is a filamentous pad strip.

4. An improved flyscreen and door assembly as claimed in claim 1, wherein said first brush is positioned such that it touches and brushes over the surface of said static panel of said door.

5. An improved flyscreen and door assembly as claimed in claim 1, wherein said projecting limb is adapted to be demountable from said slidable frame.

6. An improved flyscreen and door assembly as claimed in claim 5, wherein a plurality of interchangeable projecting limbs are provided of differing projection lengths to suit different extents of projection of the door handle.

7. An improved flyscreen and door assembly as claimed in claim 1, wherein a brush is provided on the top edge of said slidable frame extending substantially along its entire length.

8. An improved flyscreen and door assembly as claimed in claim 1, wherein a brush is provided on the bottom edge of said slidable frame extending substantially along its entire length.

9. An improved flyscreen and door assembly as claimed in claim 1, wherein a brush is provided extending along the top edge of the projecting limb of said slidable frame.

10. An improved flyscreen and door assembly as claimed in claim 1, wherein a brush is provided extending along the bottom edge of the projecting limb of said slidable frame.

11. An improved flyscreen and window assembly comprising:

a window having a static panel and an a generally horizontally slidable opening panel and a generally upright jamb defining one side of an opening of the window;

a flyscreen comprising a track and a reciprocably slidable frame within said track, said frame slidingly deployed within said track for back and forth movement across the opening of the window, said frame being dimensioned to correspond to the dimensions of the window opening to be covered by the flyscreen, said frame having a mesh screen therein extending thereacross and having generally upright lateral sides;

a first brush mounted on and extending substantially the full height of one of said lateral sides of said slidable frame which first brush is positioned such that, when said slidable frame slidingly moves back and forth in front of the opening of the window, said first brush passes closely over the surface of the static panel of the window, wherein said first brush mounted on said slidable frame is provided on a projecting limb of said slidable frame that projects from said slidable frame toward the plane of said door static panel but is dimensioned so as to allow said flyscreen to clear a door handle but ensure that said first brush remains in close proximity to the door static panel as said slidable frame is slid back and forth; and a second brush mounted on said generally upright jamb of the window against which the edge of the trailing lateral side of the slidable frame comes to rest when the flyscreen is drawn closed to completely overlie the opening of the window, said second brush extending substantially the height of said jamb and serving to cooperatively engage against said first brush mounted on said slidable frame to substantially seal the edge of said trailing lateral side of said slidable frame against ingress, by insects.

12. An improved flyscreen and window assembly as claimed in claim 11, wherein at least one of said static panel and said opening panel is a glazing pane.

13. An improved flyscreen and window assembly as claimed in claim 11, wherein at least one of said first brush and said second brush is a filamentous pad strip.

14. An improved flyscreen and window assembly as claimed in claim 11, wherein said first brush is positioned such that it touches and brushes over the surface of said static panel of said window.

15. An improved flyscreen and window assembly as claimed in claim 11, wherein said projecting limb is adapted to be demountable from said slidable frame.

16. An improved flyscreen and window assembly as claimed in claim 15, wherein a plurality of interchangeable projecting limbs are provided of differing projection lengths to suit different extents of projection of the window.

17. An improved flyscreen and window assembly as claimed in claim 11, wherein a brush is provided on the top edge of said slidable frame extending substantially along its entire length.

18. An improved flyscreen and window assembly as claimed in claim 11, wherein a brush is provided on the bottom edge of said slidable frame extending substantially along its entire length.

19. An improved flyscreen and window assembly as claimed in claim 11, wherein a brush is provided extending along the top edge of the projecting limb of said slidable frame.

20. An improved flyscreen and window assembly as claimed in claim 11, wherein a brush is provided extending along the bottom edge of the projecting limb of said slidable frame.

* * * * *